US005083241A

United States Patent [19]

Foster

[11] Patent Number: 5,083,241

[45] Date of Patent: Jan. 21, 1992

[54] PORTABLE LIGHT/TABLE

[76] Inventor: Allen L. Foster, 2351 Valley West Dr., Santa Rosa, Calif. 95401

[21] Appl. No.: 736,493

[22] Filed: Jul. 26, 1991

[51] Int. Cl.[5] ..... F21V 33/00

[52] U.S. Cl. ..... 362/33; 108/23; 362/127

[58] Field of Search ..... 362/33, 127, 133, 388, 362/125, 253, 430, 432; 108/23

[56] References Cited

U.S. PATENT DOCUMENTS 4,803,606 2/1989 Rotter ..... 362/250
4,905,609 3/1990 Haskins ..... 108/23

FOREIGN PATENT DOCUMENTS 1150479 8/1957 France ..... 362/127

*Primary Examiner*—Ira S. Lazarus
*Assistant Examiner*—Leonard Heyman
*Attorney, Agent, or Firm*—Larry D. Johnson

[57] ABSTRACT

A portable light and table provides a caster-mounted work/storage table having an angularly-adjustable light panel attached to its table surface. One side of the light panel bears at least one work table light (preferably incandescent bulb-type) that can be generally directed to illuminate the table surface, and the other side of the light panel bears at least one work area light (preferably fluorescent bulb-type), which can be simultaneously adjustably directed to illuminate a work area adjacent the work/storage table.

4 Claims, 3 Drawing Sheets

PORTABLE LIGHT/TABLE

BACKGROUND OF THE INVENTION

1. Field of the Invention

This invention relates generally to light fixtures and related apparatus, and more specifically to an improved work and storage table.

2. Description of the Prior Art

Portable lights, such as those used by mechanics, warehouse workers, and the like, are well known. Many such lights provide a stand or support to direct a beam of light at a desired area. Other known lights can be attached to a workbench or table to illuminate the table surface. However, such lights do not simultaneously illuminate the surrounding area, requiring the user to repeatedly reorient the light from the table surface to the surrounding area, or to initially install a plurality of independently oriented lights.

SUMMARY OF THE INVENTION

The portable light and table of this invention provides a caster-mounted work/storage table having an angularly-adjustable light panel attached to its table surface. One side of the light panel bears at least one work table light (preferably incandescent bulb-type) that can be generally directed to illuminate the table surface, and thus acts as a traditional workbench light. The other side of the light panel bears at least one work area light (preferably fluorescent bulb-type), which can be simultaneously adjustably directed to illuminate the work area adjacent the work/storage table.

The preferred embodiment of the portable light and table includes a retractable extension cord for removable connection to an AC power source, and an electrical outlet bar itself connected to the extension cord, providing additional electrical outlets for tools and the like. The preferred embodiment further provides for the fluorescent light bulb ballasts to be placed within the work/storage table for better weight equalization, and for some or all of the light bulbs in the apparatus to be covered with a protective wire screen to prevent breakage.

Thus, the portable light and table of this invention can be used by construction workers, mechanics, carpenters, painters, warehouse workers, and the like. It allows the worker to have a portable work table and light that can simultaneously illuminate the work table and surrounding area, and can be adjusted to illuminate only that part of the surrounding area desired (e.g., walls, corners, ceilings). The light can be operated from any AC outlet, or by connection to an AC electric generator.

DETAILED DESCRIPTION OF A PREFERRED EMBODIMENT

Figure 1:
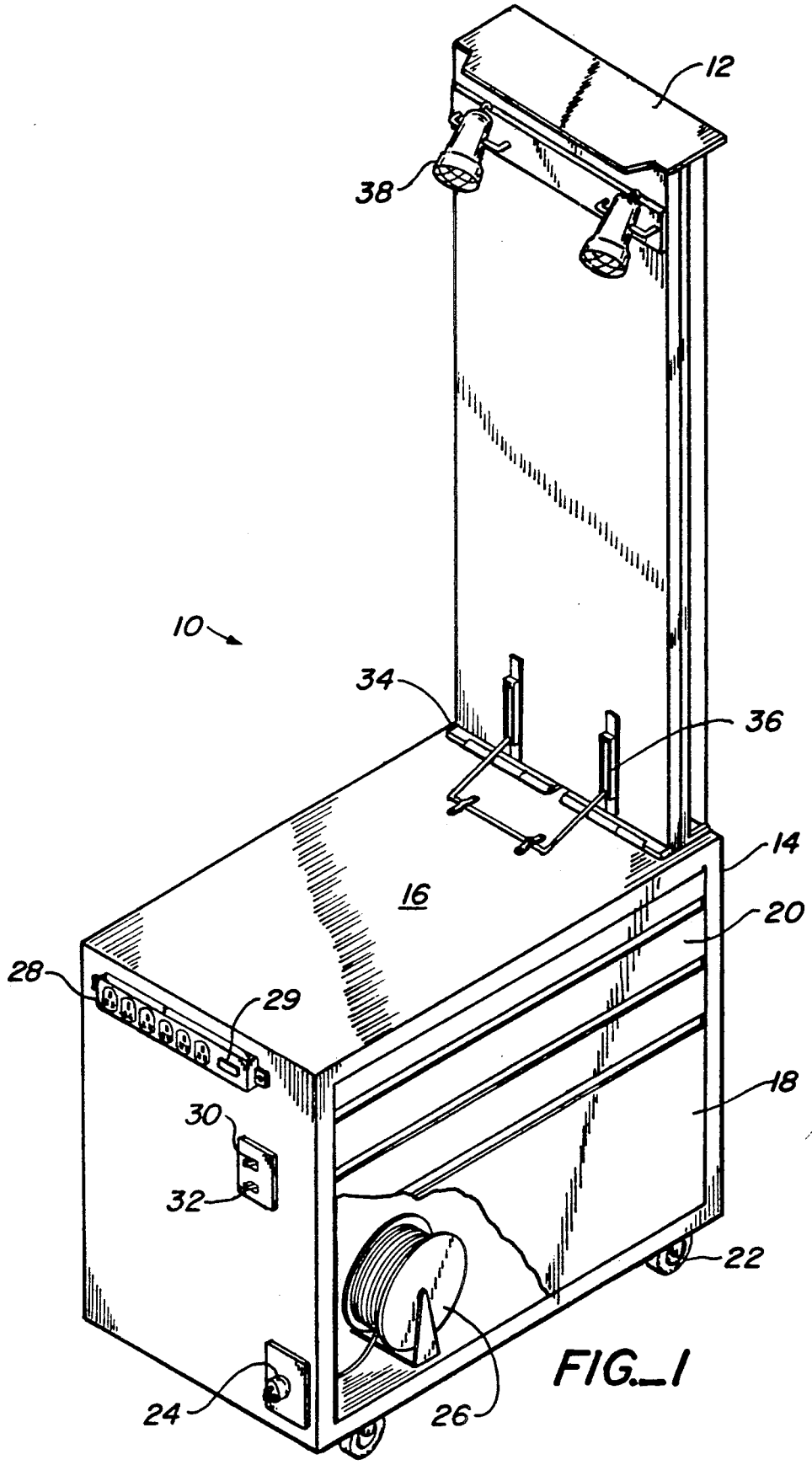
FIG. 1 is a front perspective view of the portable light and table of this invention with the light panel in its fully erect (perpendicular) position, and illustrating the work/storage table having a table surface, storage area, drawers, casters, electrical extension cord and cord retractor, electrical outlet bar, and light switches; and further illustrating the light panel hinge, adjustable support, and work table lights.

FIG. 1 is a front perspective view of the portable light and table 10 of this invention with the light panel 12 in its fully erect (perpendicular) position, and illustrating the work/storage table 14 having a table surface 16, storage area 18, drawers 20, casters or wheels 22, electrical extension cord 24 and cord retractor 26, electrical outlet bar 28 with outlet bar switch 29, and work table light switch 30 and work area light switch 32. This figure further illustrates the light panel hinge 34, adjustable support 36, and work table lights 38. The hinge and adjustable support enable the light panel to be erected or reclined as needed to illuminate a desired area.

Figure 2:
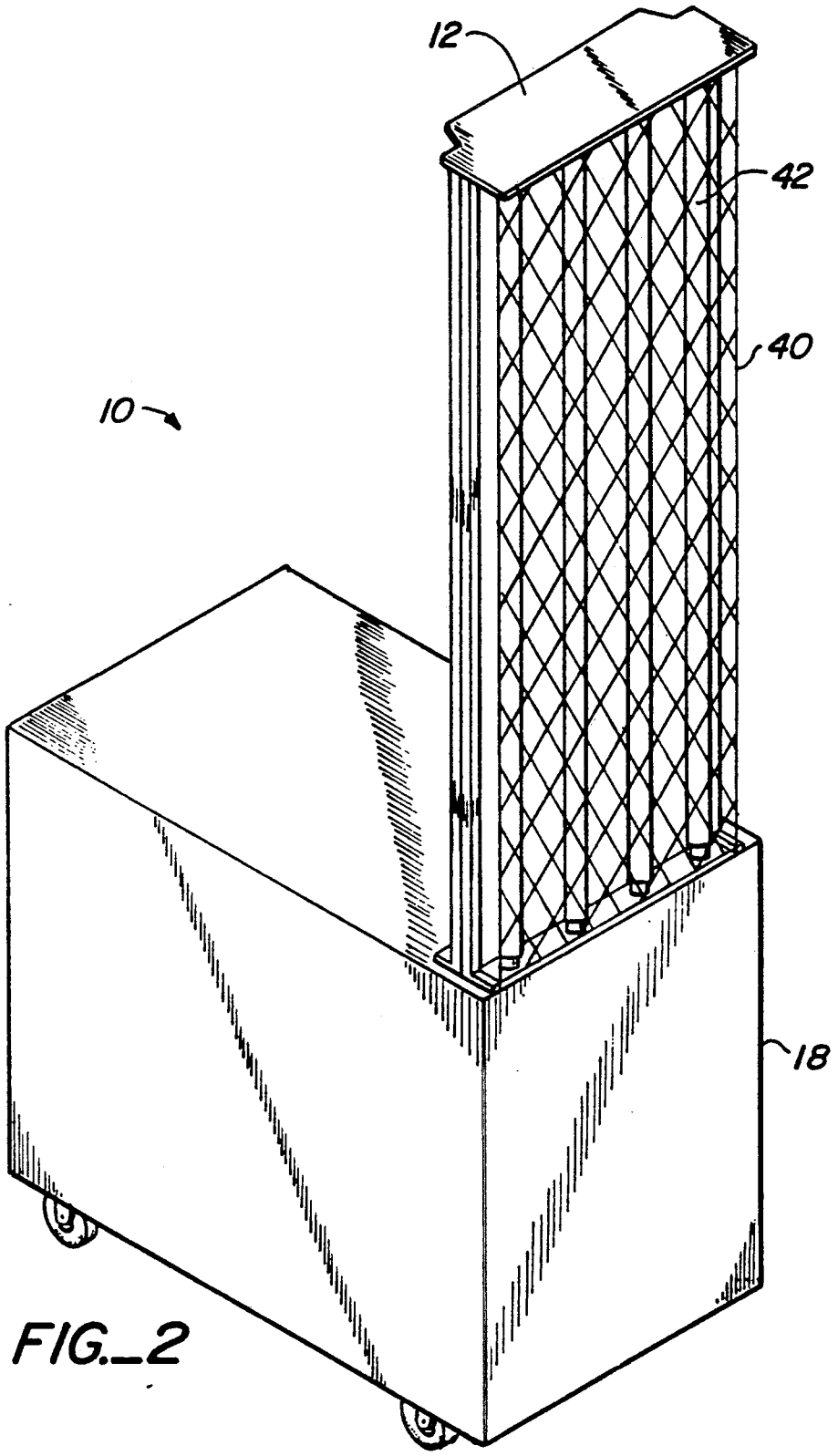
FIG. 2 is a rear perspective view of the portable light and table of this invention, again with the light panel in its fully erect (perpendicular) position, and illustrating the light panel work area lights and protective wire screen.

FIG. 2 is a rear perspective view of the portable light and table 10 of this invention, again with the light panel 12 in its fully erect (perpendicular) position, and illustrating the light panel work area lights 40 and protective wire screen 42. These work area lights are preferably fluorescent bulbs, with their ballasts housed in the storage area 18 for better stability for the apparatus.

Figure 3:
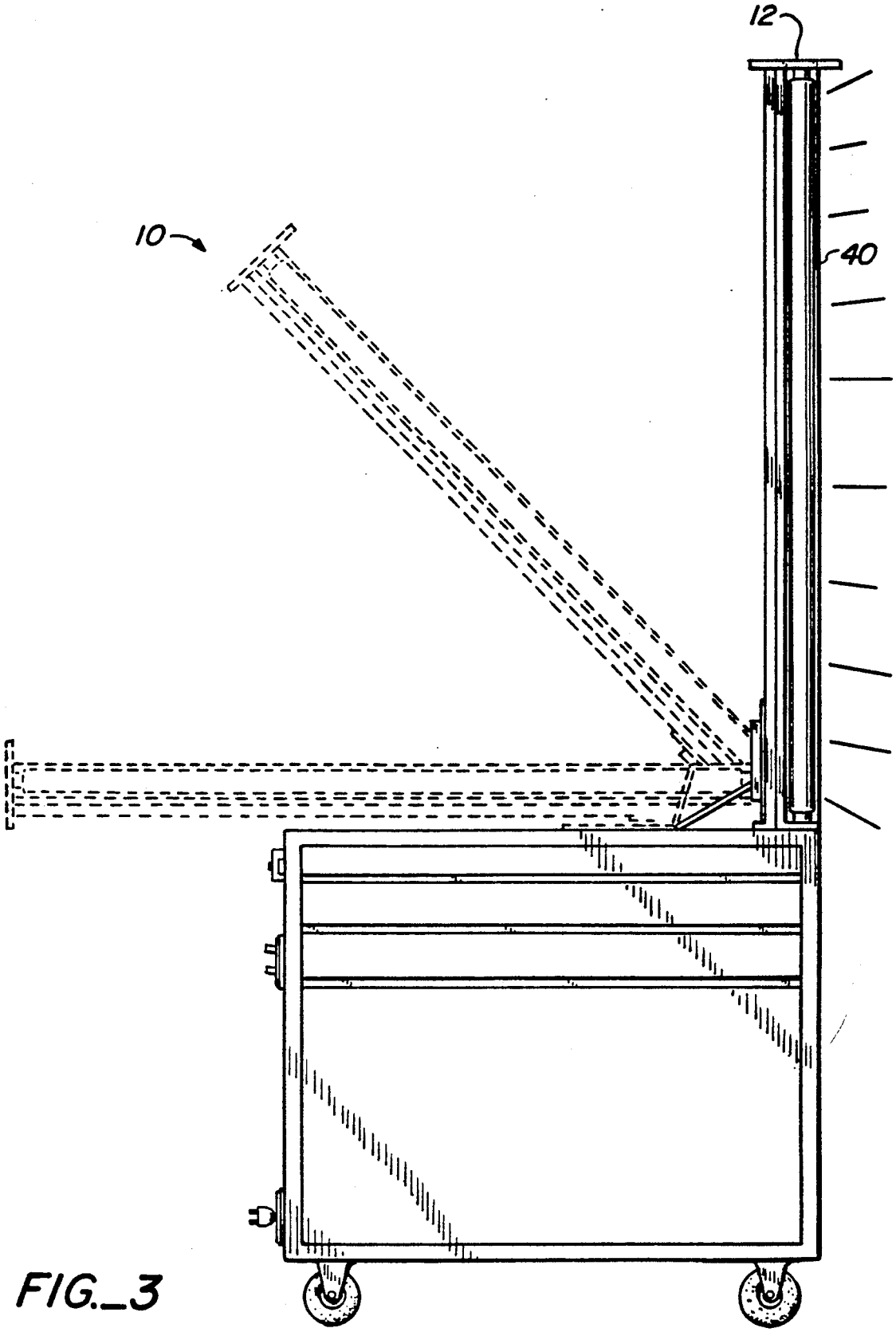
FIG. 3 is a front elevation view of the portable light and table of this invention, with the light panel illustrated in its fully erect (perpendicular) position, as well as partially erect (inclined) and non-erect (reclined or horizontal) positions (in phantom).

FIG. 3 is a front elevation view of the portable light and table 10 of this invention, with the light panel 12 illustrated in its fully erect (perpendicular) position, as well as partially erect (inclined) and non-erect (reclined or horizontal) positions (in phantom). Thus, the work area lights 40 (in particular) can be directed to illuminate any desired adjacent area, including an overhead area such as a ceiling. In addition, the reclined position is suitable for transport and storage of the apparatus.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A portable light and table of this comprising:

a work/storage table having a table surface and storage area;

a light panel portion having a first side and a second side, said first side bearing at least one work table light element, and said second side bearing at least one work area light element;

a hinge member adjustably supporting said light panel portion on said table surface;

an electrical extension cord connected to said work table light element and said work area light element; and switch means for selectively activating said work table light element and said work area light element.

2. The portable light and table of claim 1 further including an electrical extension cord retractor.

3. The portable light and table of claim 1 further including an electrical outlet bar.

4. The portable light and table of claim 1 wherein said work area light element includes a protective wire screen.

* * * * *